United States Patent [19]

Howcroft

[11] Patent Number: 4,787,445

[45] Date of Patent: Nov. 29, 1988

[54] HERMETICALLY SEALED, RELATIVELY LOW PRESSURE COOLING SYSTEM FOR INTERNAL COMBUSTION ENGINES AND METHOD THEREFOR

[75] Inventor: David E. Howcroft, Yucaipa, Calif.

[73] Assignee: Susan E. Lund, Baldwin, N. Dak.

[21] Appl. No.: 159,236

[22] Filed: Feb. 23, 1988

Related U.S. Application Data

[62] Division of Ser. No. 001,463, Jan. 8, 1987, Pat. No. 4,739,824.

[51] Int. Cl.[4] ..... F01P 11/02

[52] U.S. Cl. ..... 165/104.32; 123/41.51; 123/41.54

[58] Field of Search ..... 165/104.32; 123/41.27, 123/41.54, 41.51

[56] References Cited

U.S. PATENT DOCUMENTS

| | | | |
|---|---|---|---|
| 3,083,701 | 4/1963 | Peras | 123/41.54 |
| 3,193,041 | 7/1965 | Peras | 123/41.54 |
| 3,238,932 | 3/1966 | Simpson | 123/41.54 |
| 3,254,707 | 6/1966 | Ferguson | 165/104.32 |
| 3,425,400 | 2/1969 | Scherenberg | 123/41.51 |
| 3,498,278 | 3/1970 | Lee | 123/41.51 |
| 4,366,858 | 1/1983 | Moranne | 123/41.54 |

*Primary Examiner*—Albert W. Davis, Jr.
*Attorney, Agent, or Firm*—Brady, O'Boyle & Gates

[57] ABSTRACT

A hermetically sealed low pressure, low temperature cooling system for internal combustion engines which include a thermostat that operates at a predetermined temperature, typically 195° F. Thermostatic control of engine operation temperature is maintained at or in relatively close proximity to this predetermined temperature thereby eliminating overheating and corrosive deterioration of the cooling system. Free coolant flow between the radiator and a small expansion reservoir is maintained at all times with the expansion reservoir being integral with and located on the top portion of the radiator and to the side of a radiator filling neck also located thereat. The filling neck is provided with a transparent viewing cap so that the level of liquid coolant can be observed at all times.

13 Claims, 2 Drawing Sheets

HERMETICALLY SEALED, RELATIVELY LOW PRESSURE COOLING SYSTEM FOR INTERNAL COMBUSTION ENGINES AND METHOD THEREFOR

This is a division of application Ser. No. 001,463, filed Jan. 8, 1987, now U.S. Pat. No. 4,739,824, granted Apr. 26, 1988.

BACKGROUND OF THE INVENTION

1. Technical Field

The present invention relates to a cooling system for automotive vehicles, and more particularly relates to an improved cooling system in which liquid coolant is subjected to a comparatively low system pressure, resulting in a reduced boiling point for the liquid coolant, thus enabling the engine being cooled to operate at a controlled temperature under the influence of a thermostat in the cooling system.

2. The Prior Art

Liquid cooling systems for present-day automotive vehicles are pressurized to approximately 15 psi by use of a spring-loaded loaded pressure radiator cap. When the liquid coolant is a 50—50 mixture of water and commercial anti-freeze coolant, the boiling point of the coolant is elevated to approximately 262° F. The prevailing theory is that this pressurization and elevated boiling point is necessary to allow the radiator to retain as much coolant as possible to cool the engine.

In fact, this prevailing cooling method for today's automobiles is contrary to conventional practice, as a result of which the problems of engine overheating, and the deterioration of engine cooling systems have been magnified rather than decreased or eliminated. In high pressure liquid cooling systems which operate at high temperatures, the entire system including the radiator and water pump can be destroyed rather rapidly.

In view of the above, the primary object of the present invention is to provide an engine cooling system which allows the engine to be operated in a strictly controlled temperature range under influence of a thermostat, typically a 195° F. thermostat. The controlled cooling system according to the present invention forces the engine to operate at its thermostat temperature, without substantially overheating or underheating.

When the liquid coolant of a cooling system becomes heated, it must expand, causing an increase in pressure. The present invention allows the coolant to expand without a significant increase in system pressure as normally caused by the pressure cap on the radiator, which cap the invention does not employ. Consequently, with cooling system pressure markedly reduced, the boiling point of the coolant is correspondingly reduced and this allows the system to conform to a well-known principle of physics, i.e., the lower the pressure the lower the boiling point of a liquid. For a liquid to perform as a good coolant, it must have a low boiling point. This phenomenon is made use of in mechanical refrigeration systems where the boiling point of the most commonly used refrigerant R-12 boils at −21.7° F. Once a liquid reaches its boiling point, it can become no hotter as a liquid. The temperature of a liquid coolant at the boiling point is a major concern. The lower the boiling point temperature of the coolant, the greater the amount of heat which it can extract by conduction from the engine. High pressure, high boiling point liquids can naturally extract less heat from an engine, and it is this situation in the prior art which the present invention seeks to eliminate.

The Environmental Protection Agency requires that new automobiles be equipped with 195° F. thermostats. The Agency knows that this is the proper operating temperature to achieve best engine performance and best fuel efficiency with the least pollution. The difficulty is that the 195° F. thermostat in the modern automobile remains closed only until the cold engine, after starting, reaches the optimum thermostat temperature. At all other times, the 195° F. thermostat will remain open because the pressurized cooling system has been designed to operate in the range of 220° F. to 240° F. Thus, with the modern-day engine cooling system, the thermostat does not and cannot control the operating temperature of the engine as it was intended to do. The operating temperature of the engine is actually 25° F. to 45° F. above the temperature which the thermostat was designated to maintain. This elevated engine operating temperature results in excessive fuel consumption, greater atmospheric pollution and more rapid deterioration of the cooling system.

Similarly, most automotive pollution control systems have a thermostat controlled bypass. Since most engines operate at temperatures far above this thermostat setting, to save overheating, the pollution control system is bypassed, rendering the system ineffective most of the time.

Clutch fans are provided in automobiles to blow air over the engine to assist in cooling. These fans are thermostatically controlled as an economy measure to lessen strain on the engine. The fans engage at approximately 225° F. When the automotive engine is equipped with a cooling system thermostat, such as a 195° F. thermostat, and this thermostat is allowed to actually control engine temperature, as indeed occurs with the present invention, the cooling fan would never require activation. However, with the prevailing high pressure-high temperature cooling systems, the cooling fans operate most of the time.

Under actual testing of the present invention, during afternoon temperatures slightly in excess of 100° F., with a 195° F. thermostat in the system, the engine operated at this temperature. With a 180° F. thermostat, it operated at 180° F. With the thermostat removed entirely, allowing free flow of the coolant, the engine operated at 145° F. Thus, according to the present invention, the operating temperature of the engine is truly controlled as it should be by means of the cooling system thermostat. With the low pressure, low temperature cooling system of the present invention it is virtually impossible to overheat the system, and this feature is in accordance with another main objective of the invention.

Other features and advantages of the invention will become apparent to those skilled in the art during the course of the following detailed description.

SUMMARY OF THE INVENTION

The present invention is best summarized as a sealed low pressure, low temperature cooling system for engines in which the engine radiator is equipped with a clear sealed closure cap allowing visual inspection of the radiator coolant level at all times. An expansion reservoir or tank also formed of clear material is supported exteriorly of the radiator at the same level or slightly above the level of the customary radiator expansion fitting. This fitting and a similar fitting provided on the expansion reservoir are connected by a hose of any required length. The expansion reservoir is equipped with a sealed closure cap which can be similar to a jar lid or a standard type radiator cap. If the latter type cap is employed, it should not be equipped with a vacuum release valve, and only a pressure release valve radiator cap should be used.

Ambient air is totally excluded from the sealed system. When normal operating engine temperature is achieved under control of a thermostat, such as a 195° F. thermostat, the sealed cooling system will be pressurized within a range of 4½ to 5 psi. The liquid coolant will expand freely into the expansion reservoir which has a capacity of approximately 20 ounces. The liquid entering the expansion reservoir compresses the air trapped therein, the coolant remaining in the part of the expansion reservoir nearest the radiator. As pressure increases on the coolant in the expansion reservoir, the coolant is returned by the pressurized air into the radiator, thus assuring that the cooling system remains full of coolant at all times for optimum engine cooling efficiency under thermostatic control. Since the system is hermetically sealed, oxygen is excluded and the system remains substantially free of oxidation or corrosion for the life of the automobile or other vehicle.

A second embodiment of the invention unites the expansion reservoir with the radiator and places the reservoir at the top of the radiator, separated therefrom by plates with a tube connecting the interiors of the radiator and expansion reservoir. The customary hoses and hose clamps of the vehicle cooling system are eliminated. The two embodiments of the invention involve the same principle of operation.

DETAILED DESCRIPTION

Figure 1:
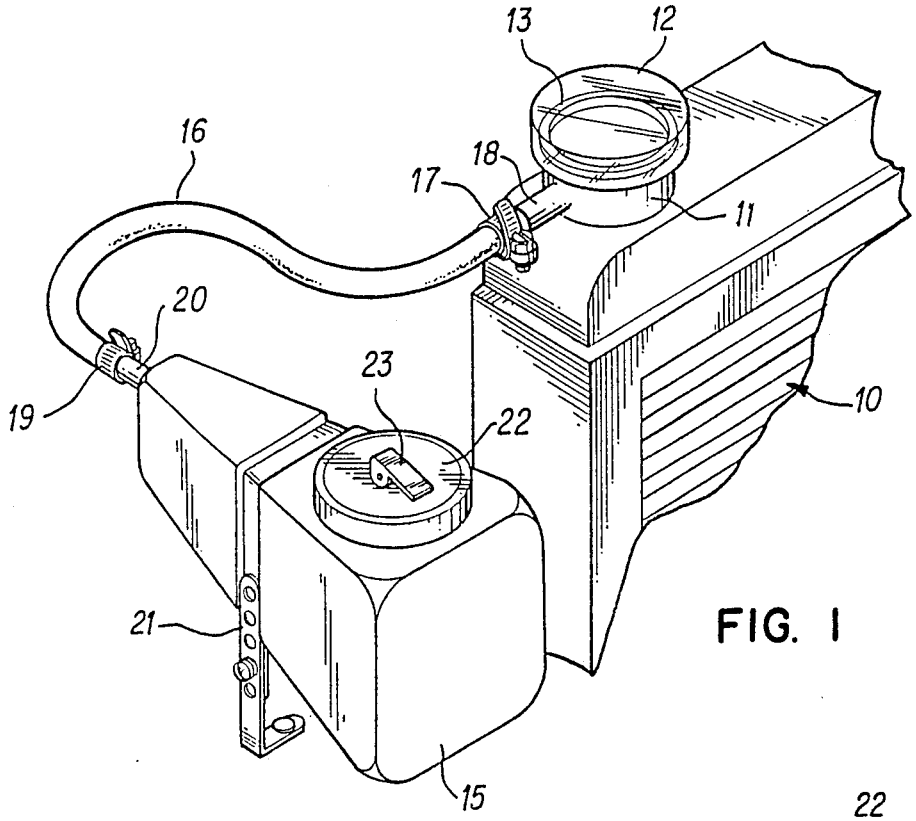
FIG. 1 is a perspective view of an engine cooling system according to the present invention.

Referring to the drawings in detail wherein like numerals designate like parts, the numeral 10 designates a cooling radiator for an automobile engine or the like, not shown. The radiator 10 has a top filling neck 11 normally equipped with spaced upper and lower flanges which are engaged by the customary spring-loaded high pressure cap which the present invention omits entirely. Instead of this cap, a durable clear radiator closure cap 12 having a neoprene seal 13 is applied to the filling neck 11, with the seal 13 engaging the top lip or flange 14 of the neck 11 to hermetically seal the same. The customary lower lip or flange normally engaged by the high pressure radiator cap can be omitted from the radiator structure, and if present on existing radiators is not utilized, that is to say, is not engaged in any way by the clear closure cap 12. Therefore, the lower sealing flange of existing radiators does not impede the outflow of coolant from the radiator into an expansion reservoir in accordance with the present invention, as will be further described.

A preferably clear plastic expansion reservoir or tank 15 forming an important element of the invention is connected by a flexible hose 16 of any required length with the radiator 10. More particularly, the hose 16 is connected by a first clamp 17 with the usual horizontal overflow nipple 18 of the neck 11. The elevation of the nipple 18 establishes the level of liquid in the radiator 10 when the cooling system is full. A second clamp 19 connects the other end of the hose 16 with a horizontal nipple 20 carried by one end of the expansion reservoir 15. The nipple 20 is arranged at the same elevation as the nipple 18, or slightly above this elevation, so that liquid coolant in the expansion reservoir 15 is able to flow by gravity back into the radiator 10 at proper times.

The reservoir 15 is stably supported at any convenient location on existing vehicle structure by an adjustable height strap or bracket means 21 of any preferred type.

For emergency purposes primarily, the expansion reservoir 15 is equipped with a sealed simple twist-off cap 22 or, if preferred, a standard type radiator cap having a pressure release valve 23.

Assuming that the cooling system is free of leaks and full of coolant, it will be necessary to add coolant to the system at very infrequent intervals only since there will be no escape of coolant from the low pressure, low temperature system. However, should the addition of coolant be necessary because of a leak or after cleaning and flushing of the system, the cap 12 is removed to facilitate this filling or refilling.

The expansion reservoir 15 can be of any convenient shape. It remains empty normally, and its purpose is for receiving expanded coolant only, as will be further explained. It is preferable and more practical for the expansion reservoir 15 to be comparatively shallow in its vertical dimension so that horizontal flow of coolant to and from the radiator at proper times is not inhibited.

Operation

When the engine is started, the conventional thermostat, not shown, remains closed until the engine reaches its normal operating temperature, namely, 195° F. for newer automobiles. The proper thermostat is chosen, in all cases, to establish and maintain the desired engine operating temperature.

When the heated coolant normally a 50—50 mixture of water and commercial anti-freeze expands, such expanded coolant can freely enter the reservoir 15 through the nipple 18, hose 16 and nipple 20 since there is no restrictive effect on such flowing caused by the sealed cap 12. In so flowing into the reservoir 15, the expanding coolant will create its own relatively low pressure, pushing ahead of it the air trapped within the sealed reservoir 15 toward the back of the reservoir remote from the radiator 10, the coolant remaining in the end of the reservoir nearest the nipple 20 and radiator.

As the pressure increases in the reservoir 15, the trapped air therein pushes the coolant back into the radiator 10. This pressure will increase only to about 4½ to 5 psi and approximately five ounces of coolant will expand into the twenty ounce capacity reservoir 15, the rest of whose capacity is taken up by trapped air. This trapped air in the reservoir continues to push against the coolant, insuring that the radiator 10 and the entire cooling system remains 100% full at all times.

Maintaining pressure of only 4½ to 5 psi in the coolant system greatly lowers the boiling point of the coolant, from which it follows that the functional temperature of the coolant remains low. This low temperature coolant is forced into and through the engine cooling jackets by the water pump. The low temperature coolant can extract a much greater amount of heat from the engine than the customary high pressure, high temperature coolants employed in today's automobile.

When the initially cold engine is started and reaches normal operating temperature, 195° F., the thermostat opens, releasing coolant into the radiator 10 to be cooled. The thermostat continues to open and close automatically for maintaining and controlling the temperature of the engine.

Since the cooling system is hermetically sealed, no fresh air or oxygen can enter the system and any oxygen initially in the system is quickly dissipated or absorbed. Therefore, the entire cooling system is protected from oxidation and will remain it its original uncorroded state throughout the life of the vehicle.

Figure 3:
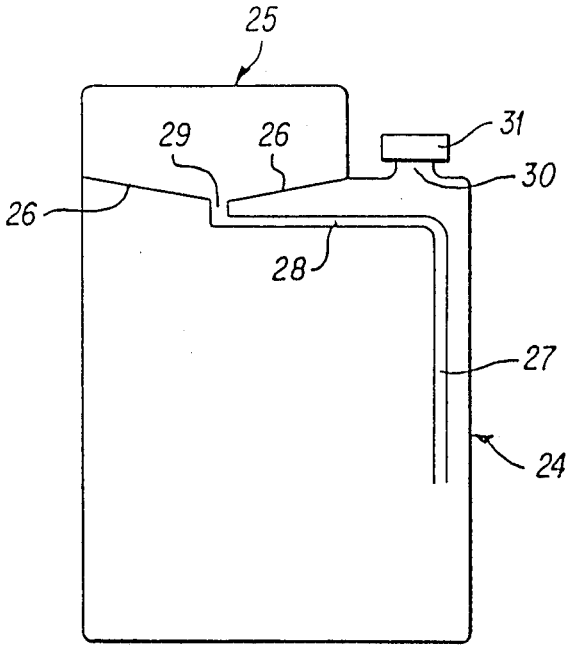
FIG. 3 is a partly schematic side elevation of a united radiator and expanded coolant reservoir according to a second embodiment of the invention.
Figure 4:
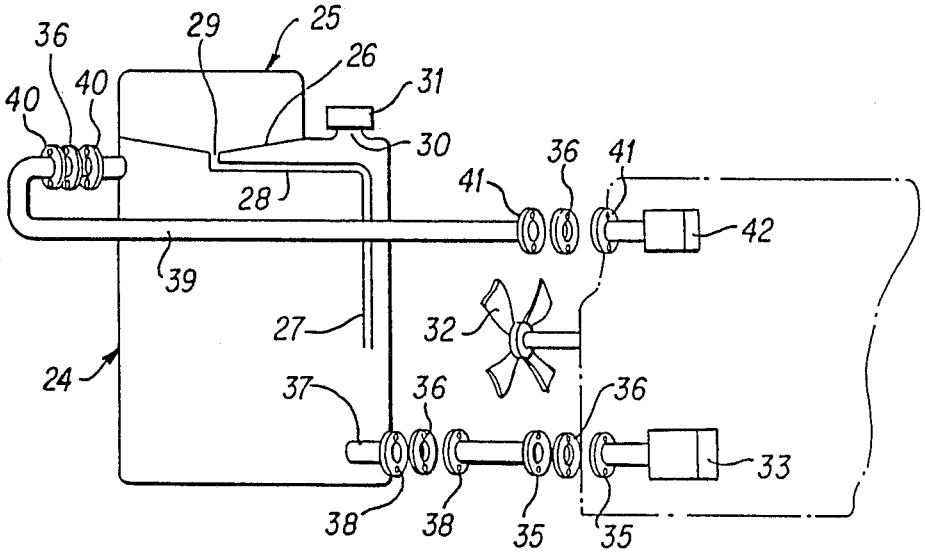
FIG. 4 is a schematic view of the cooling system according to the second embodiment of the invention.

FIGS. 3 and 4 of the drawings depict a second embodiment of the invention particularly suitable for newly manufactured vehicle cooling systems of the water and anti-freeze types. The invention according to the second embodiment can also be installed on existing vehicles in the field, if desired.

In FIGS. 3 and 4, the radiator 24 is united with a small capacity top expanded coolant reservoir 25 having a capacity of approximately 25 fluid ounces. The reservoir 25 is separated from the radiator 24 by plates 26. A small diameter tube 27 extends vertically inside of the radiator 24 and has its open lower end terminating approximately at the mid-point of the height of the radiator. This tube includes an upper horizontal branch 28 near and below the top of the radiator and the plates 26 and being in communication with the interior of the reservoir 25 through an aperture 29 within or defined by the plates 26. Otherwise, the expanded coolant reservoir 25 is entirely separated from the interior of the radiator 24.

At its top, the radiator 24 has an unrestricted filling neck 30 sealed by a removable transparent cap 31, which may be identical to the previously-described cap 12. When the radiator is filled with coolant through the neck 30, there is no danger of overfilling into the expansion reservoir 25 because the neck 30 is at or near the level of the plates 26 and the radiator will overflow through the neck 30 before any coolant could rise into the reservoir 25.

The arrangement provides a completely hermetically sealed cooling system having basically the same mode of operation and advantages described for the prior embodiment having the separate expanded coolant reservoir 15. In addition to its simplicity and unitary construction, the cooling system in FIGS. 3–4 entirely eliminates the traditional rubber hoses and hose clamps of automotive cooling systems which are known to be the focal points of most problems arising in cooling systems. The rubber hoses rapidly deteriorate and sometimes burst under the high pressure of conventional cooling systems and the hose clamps frequently become loose due to engine vibration.

As shown in FIG. 4, the radiator cooling fan is indicated by the numeral 32. A water pump 33 is connected to a metal tube 34 by opposing apertured plates or flanges 35 which are bolted together with a sealing gasket 36 placed between them to effect an air and liquid tight seal. The tube 34 is similarly connected to a radiator coolant inlet metal tube 37 by an additional pair of apertured plates 38 which are also bolted together with one of the sealing gaskets 36 interposed therebetween.

At a higher elevation on the radiator 24, a metal coolant outlet tube 39 is connected into the radiator by another pair of opposed apertured plates 40 having one of the sealing gaskets 36 disposed therebetween. Exteriorly of the radiator 24, the tube 39 is connected by still another pair of apertured plates 41 having a gasket 36 therebetween with a thermostat housing 42.

By these described means, the unified cooling system is completely hermetically sealed and external air is excluded from the system, thereby minimizing oxidation and corrosion, as previously explained.

Figure 2:
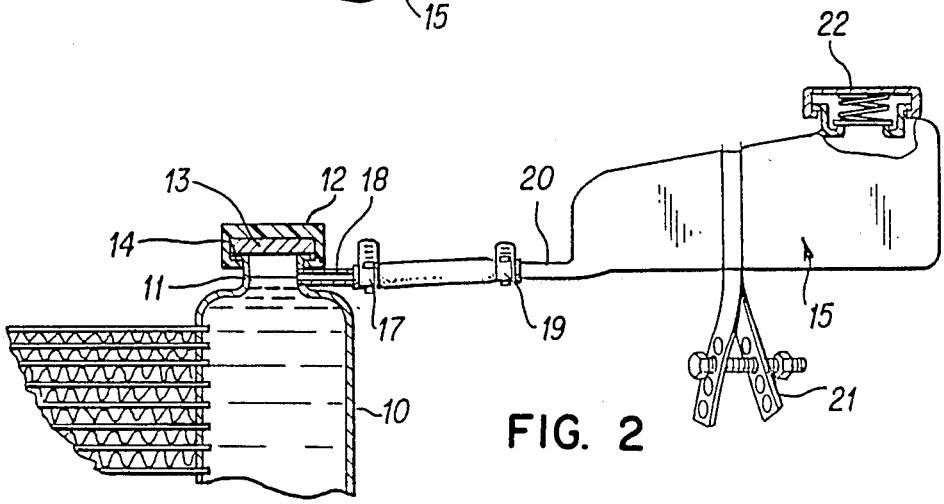
FIG. 2 is a fragmentary side elevation of the cooling system, partly in cross section.

The mode of operation of the system is essentially the same as described for the prior embodiment in FIGS. 1 and 2. When the engine and cooling system reach normal operating temperature under full thermostat control at all times, a small volume of expanded coolant will pass through the tube 27 into the expansion reservoir 25 and the coolant will interface with and compress the air trapped in the reservoir 25. This enables the system to create its own internal pressure which will be at least 10 psi less than the pressure of today's conventional cooling systems for vehicles. As the thermostat continues to regulate the system temperature, compressed air and gravity will return the expanded coolant from the reservoir 25 to the radiator 24 to maintain the latter full at all times.

The expanded coolant reservoir 25 is preferably made of the same material as the radiator 24 to promote efficiency of manufacturing the system.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A cooling system for engines comprising a united radiator and expanded coolant reservoir separated by partition means near the top of the radiator and bottom of said reservoir, said reservoir being mounted atop the radiator, a tube having one end connected through the partition means with the interior of said reservoir and being located inside of said radiator and descending in the radiator to an elevation near the center of height of the radiator and having an open bottom end, whereby expanded coolant may pass through said tube from the radiator into said reservoir and may return through said tube from the reservoir to the radiator under influence of compressed air trapped in said reservoir, a filling neck on said radiator at its top and at an elevation substantially adjacent to the partition means, and a transparent sealed closure cap on the filling neck.

2. A cooling system as defined in claim 1, and liquid coolant inlet and outlet metal tubes connected into said radiator near its top and bottom respectively and being adapted for hermetically sealed connections with a water pump and thermostat housing respectively.

3. A cooling system as defined in claim 2, and said tubes having corresponding ends connected into said radiator by pairs of opposed apertured plates which are bolted together with a sealing gasket interposed between them to effect a hermetic seal, and the other corresponding end of said tubes being connected with said water pump and thermostat housing by pairs of opposed apertured plates which are bolted together with a sealing gasket interposed therebetween to effect a hermetic seal.

4. A hermetically sealed, relatively low pressure cooling system for internal combustion engines including a thermostat which opens at a predetermined engine operating temperature, comprising:

a hermetically sealed radiator having a filling neck located in the top portion of the radiator, a non-pressurized cap in sealed relationship with said filling neck;

a small expansion reservoir for liquid coolant integral with and connected in hermetically sealed relationship with the top portion of the radiator forming a composite structure thereby, said reservoir having coolant inlet means which projects downwardly into the radiator so that coolant will reside in the lower portion of the expansion chamber when said radiator is filled with coolant and having a closed dead air space in the upper portion of the expansion reservoir wherein liquid coolant due to engine heating during operation expands and flows freely from the radiator upwardly and into said expansion reservoir causing a relatively low pressure to be built up in the dead air space behind the coolant and subsequently returning from the reservoir into the radiator under the influence of the relatively low pressure in the closed dead air space to maintain the cooling system full at a full level at all times, whereby pressure in the hermetically sealed cooling system is maintained at a relatively low value compared to conventional high pressure systems which operate at or near 15 psi, said low pressure causing the boiling point of the coolant to remain at a relatively low value, permitting said thermostat of the engine to thereby control engine temperature over substantially the full range of engine operation and thus causing said engine to operate at a temperature at or in relatively close proximity to said predetermined temperature of the thermostat.

5. The system as defined by claim 4 wherein coolant inlet means is located in the lower portion of said reservoir.

6. The system as defined by claim 5 wherein the lower portion of said reservoir includes separation means downwardly sloping from the side to the middle of the reservoir and wherein said coolant inlet means is located at the lower extremity of said separation means.

7. The system as defined by claim 4 wherein said coolant inlet means includes a tube located inside the radiator and descending into the radiator to an elevation near the center of the height of the radiator and having an open bottom end whereby expanded coolant may pass through said tube to and from said reservoir.

8. The system as defined by claim 4 wherein said reservoir is located to the side of said filling neck on top of said radiator.

9. The system as defined by claim 4, and additionally including respective liquid coolant inlet and outlet metal tubes connected into said radiator near the top and bottom thereof and including means for providing hermetically sealed connections with a water pump and thermostat housing, respectively.

10. The system as defined by claim 9, and said tubes having corresponding ends connected into said radiator by pairs of opposed apertured plates which are bolted together with a sealing gasket interposed between them to effect a hermetic seal, and the other corresponding ends of said tubes being connected with said water pump and thermostat housing by pairs of opposed apertured plates which are bolted together with a sealing gasket interposed therebetween to effect another hermetic seal.

11. A method of operating an internal combustion engine at a temperature corresponding to the opening and closing temperature of the thermostat installed in the cooling system of the engine, comprising the steps of:

confining liquid coolant within a hermetically sealed cooling system including a composite structure comprising a radiator and an integrally formed expansion reservoir located on a top portion of the radiator at or above the full level of coolant in the radiator and coupled to the radiator by coolant inlet means in the lower portion of the reservoir, filling the radiator to the full coolant level, allowing the coolant to expand and flow freely upwardly from the full coolant level of the radiator into the lower portion of the coolant expansion reservoir during engine operation, said reservoir further including a closed dead air space above the lower portion of the reservoir filled with coolant causing a relatively low pressure to be built up in the closed dead air space behind the coolant, and effecting automatic return of the expanded coolant in said reservoir to the radiator under the influence of said relatively low pressure in the dead air space of said reservoir behind said coolant, whereby pressure in the hermetically sealed coolant system is maintained at a relatively low level compared to conventional high pressure systems which operate at or near 15 psi, said low level being determined by the pressure behind the coolant in the closed dead air space of the reservoir, said relatively low pressure causing the boiling point and temperature of the coolant to remain at a relatively low level thereby permitting the thermostat to control the engine temperature over substantially the full operating range of the engine, and thus causing said engine to operate at or in relatively close proximity to said predetermined temperature of the thermostat.

12. The method as defined by claim 11 wherein said expansion reservoir is formed to the side of a filling neck also located on top of said radiator.

13. The method as defined by claim 11 wherein said coolant inlet means includes a tube descending into the body of the radiator.

* * * * *